US009429131B2

(12) United States Patent
Bradfield

(10) Patent No.: US 9,429,131 B2
(45) Date of Patent: Aug. 30, 2016

(54) STARTER SYSTEM AND METHOD

(71) Applicant: Remy Technologies, LLC, Pendleton, IN (US)

(72) Inventor: Michael D. Bradfield, Anderson, IN (US)

(73) Assignee: Remy Technologies, LLC, Pendleton, IN (US)

( * ) Notice: Subject to any disclaimer, the term of this patent is extended or adjusted under 35 U.S.C. 154(b) by 413 days.

(21) Appl. No.: 14/163,336

(22) Filed: Jan. 24, 2014

(65) Prior Publication Data

US 2015/0211465 A1 Jul. 30, 2015

Related U.S. Application Data

(60) Provisional application No. 61/802,969, filed on Mar. 18, 2013.

(51) Int. Cl.
*F02N 11/00* (2006.01)
*F02N 11/08* (2006.01)
(Continued)

(52) U.S. Cl.
CPC ..... *F02N 11/0855* (2013.01); *F02N 15/02* (2013.01); *F02N 15/067* (2013.01); *F02N 2015/061* (2013.01); *F02N 2200/022* (2013.01); *F02N 2200/023* (2013.01); *F02N 2200/041* (2013.01); *F02N 2300/2011* (2013.01)

(58) Field of Classification Search
CPC ..... F02N 11/08; F02N 11/0814; F02N 11/0818; F02N 11/14; F02N 2200/048; F02N 11/0851; F02N 11/0855; F02D 41/042; F02D 41/062; F02D 41/009
USPC ..... 123/179.3, 179.4, 179.26; 903/914; 701/113
See application file for complete search history.

(56) References Cited

U.S. PATENT DOCUMENTS 6,024,065 A 2/2000 Hojna et al.
2005/0182541 A1* 8/2005 Tamaizumi ..... B62D 5/046 701/41
2008/0115753 A1 5/2008 Noguchi
(Continued)

FOREIGN PATENT DOCUMENTS

JP 2000-314364 A 11/2000

OTHER PUBLICATIONS

International Search Report and Written Opinion; PCT/US2014/030104; Aug. 8, 2014.

*Primary Examiner* — Thomas Moulis
*Assistant Examiner* — Joshua A Campbell
(74) *Attorney, Agent, or Firm* — Bose McKinney & Evans LLP

(57) ABSTRACT

A method for controlling an engine starter system including a starter capable of being controlled by an electronic control unit and having an electric motor and a pinion coupled together for transferring rotational torque from the motor to the pinion when the motor is activated; controlling activation of the motor with an electronic control unit output motor signal in response to an engine speed input signal; determining the pinion speed in an open loop manner based solely on the time since activation of the motor and the voltage applied to the motor; and selectively moving the pinion between a retracted state and an extended state in response to an electronic control unit output pinion signal, whereby the starter is capable of selectively engaging an engine for cranking the engine. Also, a starter system that facilitates this method.

20 Claims, 15 Drawing Sheets

(51) Int. Cl.
*F02N 15/06* (2006.01)
*F02N 15/02* (2006.01)

(56) References Cited

U.S. PATENT DOCUMENTS

2010/0242905 A1* 9/2010 Machida ..... F02N 11/0844 123/339.14
2011/0118962 A1* 5/2011 Couetoux ..... F02N 11/0844 701/113
2011/0132307 A1* 6/2011 Patterson ..... F02N 11/0814 123/179.3
2012/0191329 A1 7/2012 Roessle et al.
2012/0221208 A1* 8/2012 Kojo ..... B62D 5/0469 701/41
2012/0256524 A1* 10/2012 Fulton ..... F02N 15/067 310/68 E
2012/0290194 A1* 11/2012 Shoda ..... F02N 11/0855 701/104
2012/0318227 A1* 12/2012 Hashimoto ..... F02N 11/0855 123/179.3
2013/0168974 A1* 7/2013 Bradfield ..... F02N 11/0855 290/38 C
2013/0325304 A1* 12/2013 Kondo ..... F02D 29/02 701/113
2015/0211465 A1* 7/2015 Bradfield ..... F02N 11/0855 123/179.3

* cited by examiner

500

STARTER SYSTEM AND METHOD

CROSS-REFERENCE TO RELATED APPLICATION(S)

This application claims the benefit under Title 35, U.S.C. §119(e) of U.S. Provisional Patent Application Ser. No. 61/802,969, entitled STARTER SYSTEM AND METHOD, filed on Mar. 18, 2013, the entire disclosure of which is expressly incorporated herein by reference.

BACKGROUND

The present disclosure relates to engine starter systems and, more particularly, to controlling the operation of starters in such systems.

Electric machines such as starters play important roles in the operation of vehicles. A typical vehicle includes a conventional starter system which, upon the vehicle driver closing an ignition switch, cranks the vehicle engine, which then, when started, runs continuously until the driver manually stops its operation by manipulating the ignition switch. Vehicles having starter systems capable of facilitating frequent engine start and stop operation while being driven to avoid or reduce engine idling periods are becoming more commonplace in modern vehicles, and such operation requires the starter to operate at high efficiency under both cold and warm engine cranking conditions. Moreover, such starter systems rely on control systems, rather than solely upon a driver-manipulated ignition switch, to activate and deactivate the starter, typically in response to vehicle conditions and/or driver inputs. The demands of frequent engine stop-start operations require starter systems and components that function evermore rapidly and efficiently to increase reliability, reduce energy consumption, and enhance the driving experience.

Implementing prior starter systems capable of frequent stop-start operations typically requires considerable additional control electronics and sensor beyond those normally present in vehicles having conventional starter systems. Such systems employ, for example, closed loop control systems that rely on feedback indicative of starter motor or pinion position or speed obtained through at least one additional, dedicated sensor incorporated into the starter system solely for that purpose. Moreover, such prior systems typically house the starter control electronics in a dedicated module adapted to receive the feedback signal(s) from the added starter speed/position sensor(s), significantly complicate packaging vehicle electronics, and increase system part complexity.

A starter system capable of facilitating frequent engine stop-start operations, so as to provide the above-mentioned benefits, and which also minimizes starter control electronics and modules therefor and does not require additional sensors beyond those normally present in vehicles employing even conventional starter systems, would provide a desirable advancement in the relevant art.

SUMMARY

A starter system according to the present disclosure is configured and arranged to properly engage the starter with the engine while at the same time reducing the energy consumption of the starter motor, and enhances the driving experience. A starter system according to the present disclosure performs well during cold cranking conditions at low starter speeds under relatively higher starter torque demands as well as during warm cranking conditions at high starter speeds under low starter torque demands. In conjunction with this operating parameter, some embodiments according to the present disclosure are configured and arranged to function so as to allow better engagement of the starter with the vehicle engine, which may not be at rest at the time of engagement.

Some embodiments according to the present disclosure provide a starter system including a starter having a solenoid assembly having a plunger, a motor that is coupled to a pinion that is coupled to the solenoid plunger, and an electronic control unit (ECU) that operatively controls the starter solenoid and motor.

An ECU for a starter system according to the present disclosure is capable of receiving data from one or more sensors, and calculating various starter system control parameters using one or more algorithms. The ECU for a starter system according to the present disclosure may be commonly housed in the electronics control unit containing circuitry for controlling typical engine operation functions in modern vehicles, even those vehicles employing only conventional starter systems. Advantageously, such a starter system requires no additional, dedicated sensors for obtaining feedback from the starter regarding the starter pinion or motor speed or position; the starter system facilitates determination of the starter pinion speed in an open loop manner, without the need for a control scheme reliant upon closed loop feedback by which the starter motor or pinion position or speed is sensed.

Additionally, vis-à-vis prior starter systems, a starter system according to the present disclosure simplifies facilitating engine stop-start operation capabilities, and does so without significantly complicating existing vehicle/engine electronic control architectures or increasing starter system part complexity. In some embodiments, the starter system can subsequently command the operational characteristics of one or more components of the system, including the starter itself. For example, the starter system can control the rotational speed of the starter motor and/or the solenoid plunger of the starter. The system can also, in some embodiments, control the meshing of the starter pinion with the engine ring gear to achieve a smooth, substantially synchronous engagement therebetween.

The present disclosure provides, as a first aspect, a method for controlling an engine starter system. The method includes: providing an electronic control unit having an engine speed input and at least one output; providing a starter capable of being controlled by the electronic control unit and having an electric motor and a pinion, the motor and pinion coupled together for transferring rotational torque from the motor to the pinion when the motor is activated; controlling activation of the motor with an electronic control unit output motor signal in response to an engine speed input signal; determining with the electronic control unit the pinion speed in an open loop manner based solely on the time since activation of the motor and the voltage applied to the motor; and selectively moving the pinion between a retracted state and an extended state in response to an electronic control unit output pinion signal, whereby the starter is capable of selectively engaging an engine for cranking the engine.

As a second aspect, in the above method the electronic control unit output motor signal and the electronic control unit output pinion signal are signals separately outputted from the electronic control unit.

As a third aspect, in this method the electronic control unit output motor signal and the electronic control unit output pinion signal are substantially simultaneously outputted from the electronic control unit.

As a fourth aspect, in the above method the electronic control unit output motor signal and the electronic control unit output pinion signal are a single signal outputted from the electronic control unit.

As a fifth aspect, in the above method the pinion speed determined by the electronic control unit is expressible as an explicit, closed form equation based on elapsed time since activation of the motor and the voltage applied to the motor.

As a sixth aspect, in this method the explicit, closed form equation is a quartic equation.

As a seventh aspect, in the above method, in determining the pinion speed with the electronic control unit the voltage applied to the motor is substantially battery voltage.

As an eighth aspect, in the above method, in determining the pinion speed with the electronic control unit the voltage applied to the motor is presumed to be a constant value.

As a ninth aspect, in the above method the pinion speed is a presumed predetermined speed after an identified period of time has elapsed since motor activation.

As a tenth aspect, in the above method the pinion speed is determined based at least in part as a function of an actual applied motor voltage.

As an eleventh aspect, the above method includes calculating the differential between the determined pinion speed and the engine speed input.

As a twelfth aspect, in this method the voltage applied to the motor is maintained if the determined pinion speed is less than the engine speed input.

As a thirteenth aspect, in this method the pinion is capable of being engaged with an engine ring gear if the determined pinion speed is at least the engine speed input.

The present disclosure also provides, as a fourteenth aspect, a starter system for cranking an engine. The starter system includes a starter having an electric motor and a pinion coupled together, and rotational torque from the motor is transferable to the pinion. The system also includes an electronic control unit having an engine speed input and at least one output. The motor is adapted for being activated under control of the electronic control unit in response to a motor signal outputted from the electronic control unit, and the pinion is adapted for being moved axially between a retracted state and an extended state in response to a pinion signal outputted from the electronic control unit. The starter is capable of engaging and cranking an engine in the pinion extended state, and the electronic control unit is capable of determining the pinion speed in an open loop manner based solely on the time since activation of the motor and the voltage applied to the motor.

As a fifteenth aspect, in the above starter system the electronic control unit is adapted to determine pinion speed based at least in part as a function of the voltage applied to the motor being substantially battery voltage.

As a sixteenth aspect, in the above starter system the electronic control unit is adapted to determine pinion speed based at least in part as a function of the voltage applied to the motor being presumed to be a constant value.

As a seventeenth aspect, in the above starter system the electronic control unit is adapted to adjust the pinion speed on the basis of a comparison by the electronic control unit between the determined pinion speed and the engine speed input.

As an eighteenth aspect, in the above starter system the electronic control unit has a motor output from which the motor signal is outputted from the electronic control unit and a separate pinion output from which the pinion signal is outputted from the electronic control unit.

As a nineteenth aspect, in this starter system the electronic control unit is capable of outputting the motor signal from the motor output and the pinion signal from the pinion output substantially simultaneously.

As a twentieth aspect, in the above starter system the electronic control unit output is a single output from which a single motor and pinion signal is outputted.

BRIEF DESCRIPTION OF THE DRAWINGS

The above-mentioned aspects and other characteristics and advantages of an apparatus and/or method according to the present disclosure will become more apparent and will be better understood by reference to the following description of exemplary embodiments taken in conjunction with the accompanying drawings, wherein.

Figure 1:
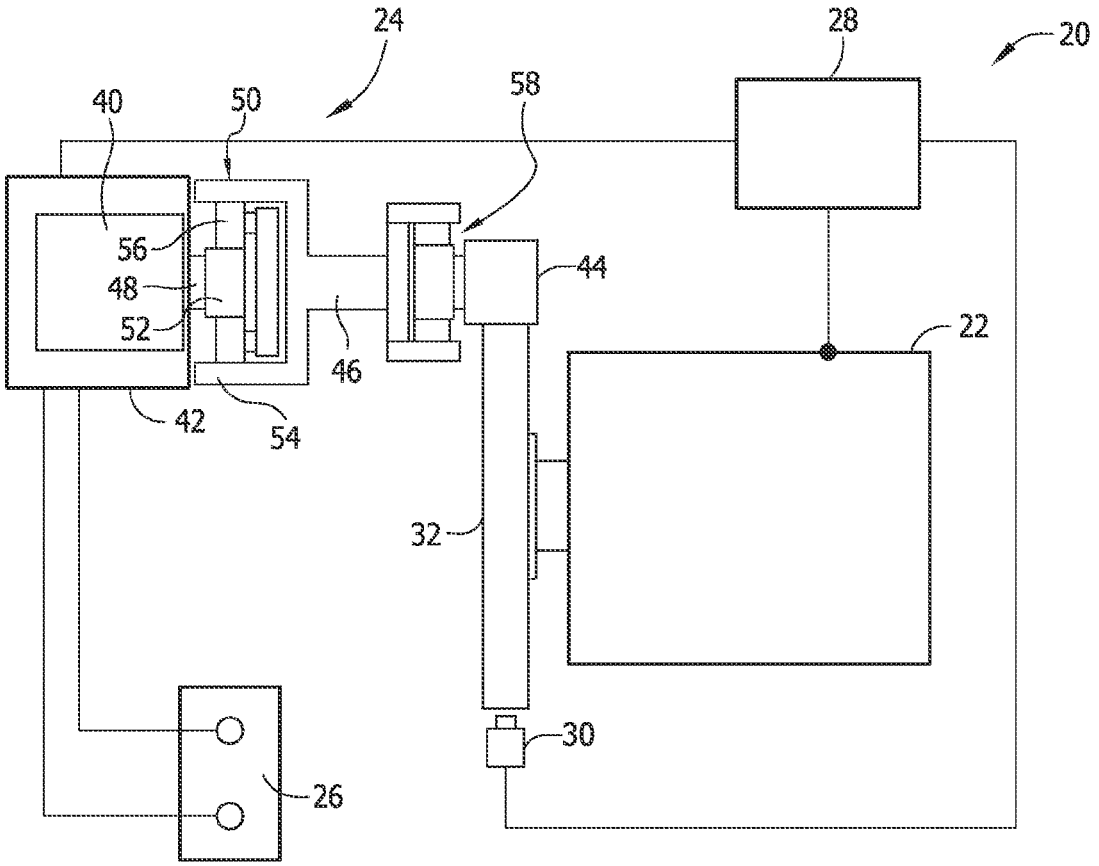
FIG. 1 is a diagram of a first embodiment starter system according to the present disclosure.

Corresponding reference characters indicate corresponding parts throughout the several views. Although the drawings represent embodiments of the disclosed apparatus and method, the drawings are not necessarily to scale or to the same scale and certain features may be exaggerated or omitted in order to better illustrate and explain the present disclosure. Moreover, in accompanying drawings that show sectional views, cross-hatching of various sectional elements may have been omitted for clarity. It is to be understood that this omission of cross-hatching is for the purpose of clarity in illustration only.

DETAILED DESCRIPTION OF EXEMPLARY EMBODIMENT(S)

The embodiments described below are not intended to be exhaustive or to limit the invention to the precise forms or steps disclosed in the following detailed description, but have been chosen and are herein described so that others skilled in the art may appreciate and understand principles and practices according to the present disclosure. It is, therefore, to be understood that the invention herein described is not limited in its application to the details of construction and the arrangement of components set forth in the following description or illustrated in the following drawings, and is capable of having other embodiments and of being practiced or of being carried out in various ways.

Further, it is to be understood that the phraseology and terminology used herein has been adopted for the purpose of description and should not be regarded as limiting. For example, the use of "including," "comprising," or "having," and variations thereof is meant to encompass the items listed thereafter and equivalents thereof as well as additional items. Unless specified or limited otherwise, the terms "mounted," "connected," "supported," and "coupled," and variations thereof are used broadly and encompass both direct and indirect mountings, connections, supports, and couplings. Moreover, "connected" and "coupled" are not restricted to physical or mechanical connections or couplings. The comparative rotational speeds of the engine ring gear and starter pinion are understood to be their tangential speeds at the radii at which they intermesh, or their rotational speeds normalized through their gear ratio and both represented by the rotational speed of one or the other.

FIG. 1 illustrates first embodiment starter system 20 for engine 22. Engine 22 is an internal combustion engine for a vehicle. Although vehicles can include starter system 20, it is to be understood that starter system 20 can be utilized in an apparatus having a stationary engine 22. System 20 includes starter 24, power source 26 such as a 12V battery, ECU 28, which may also serve as an engine control unit for controlling engine operations and contain control circuitry for starter system 20, and one or more sensors 30 used for determining engine speed. In the exemplary embodiments disclosed herein sensor 30 is used for detecting the position of engine ring gear 32, by which the speed of engine 22 may be determined by ECU 28 in a manner well-known to those having ordinary skill in the art, and as is ordinarily done in modern vehicles regardless of starter system type, the output signal of sensor 30 being provided to the vehicle's engine control unit. ECU 28 thus receives a measured engine speed input from sensor 30, which may already be included in the vehicle in a typical, known manner and need not be an additional sensor dedicated to starter system operation, thereby simplifying starter system packaging and minimizing part complexity. In the depicted embodiment, sensor 30 communicates with ECU 28 via wired and/or wireless communication protocols.

Figure 2A:
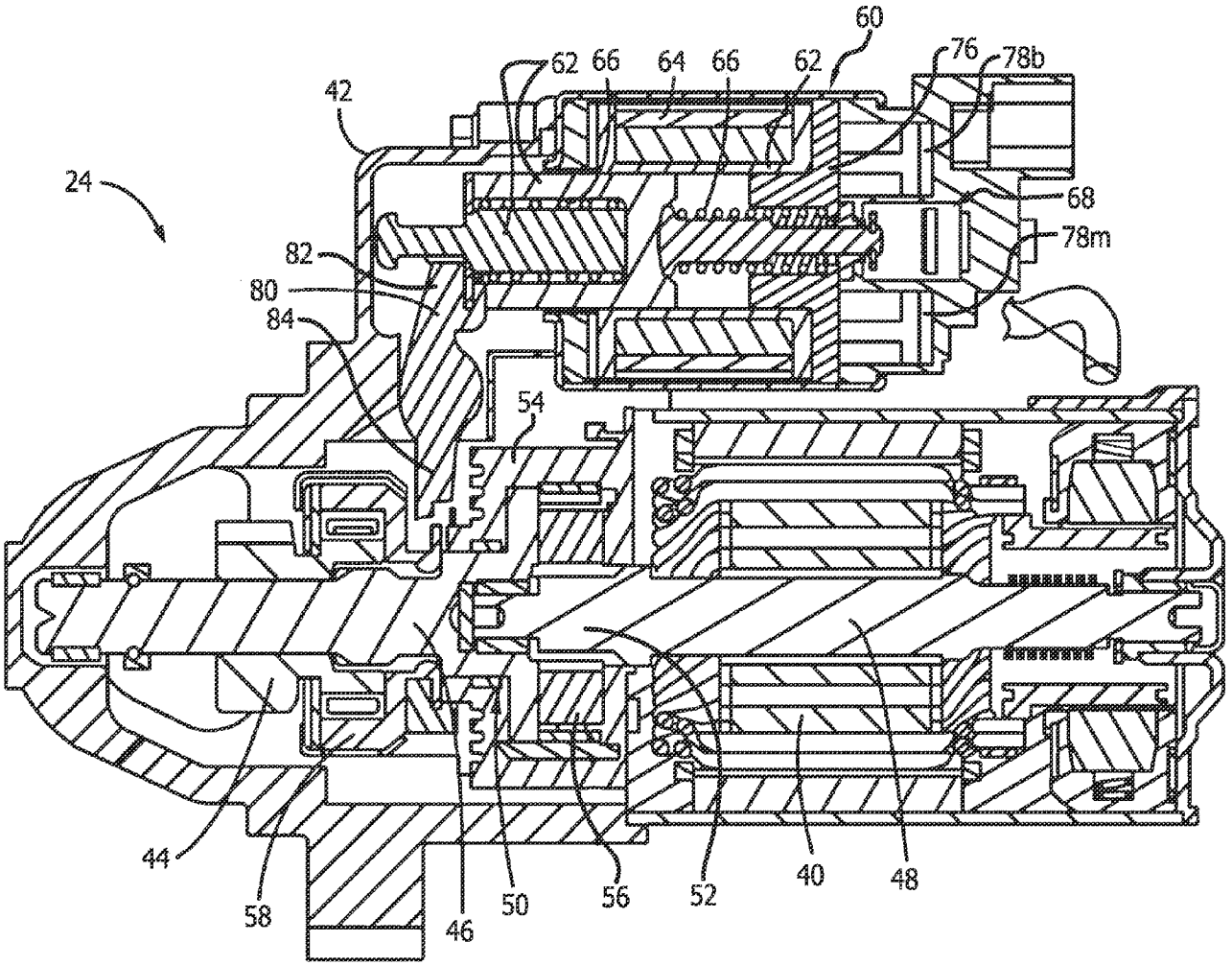
FIG. 2A is a cross-sectional view of a first embodiment starter used in the system of FIG. 1.

Referring to FIG. 2A, first embodiment starter 24 is conventional, and includes starter motor 40 disposed within starter housing 42 for rotatably driving starter pinion 44 in a single rotational direction. Starter motor 40 and pinion 44 are operably coupled through first drive shaft 46. In some embodiments, as shown, motor 40 has second drive shaft 48 which drives drive shaft 46 via gear train 50, which may be of planetary type. As depicted, sun gear 52 of planetary gear train 50 is affixed to second drive shaft 48, and ring gear 54 of planetary gear train 50 is affixed to first drive shaft 46; planetary gears 56 disposed between sun gear 52 and ring gear 54 transfer torque and rotary motion from second drive shaft 48 to first drive shaft 46. Alternatively, in certain unshown embodiments of starter 24, motor 40 drives first drive shaft 46 directly, rather than through gear train 50.

Starter 24 includes overrunning clutch 58 disposed between pinion 44 and first drive shaft 46. Clutch 58 allows pinion 44 to be rotated faster than first drive shaft 46 in their common direction of rotation, as may occur when pinion 44 and ring gear 32 are in meshed engagement and engine 22 causes pinion 44 to rotate at a speed faster than that of first drive shaft 46. Thus, clutch 58 aids in reducing a risk of damage to starter 24 and its motor 40 by permitting pinion 44 to rotate relative to first drive shaft 46, thereby allowing pinion 44 to be rotated, if still engaged with ring gear 32, at speed faster than it would be driven by motor 40, directly or through gear train 50, and preventing motor 40 from being rotated under the influence of engine torque.

Figure 2B:
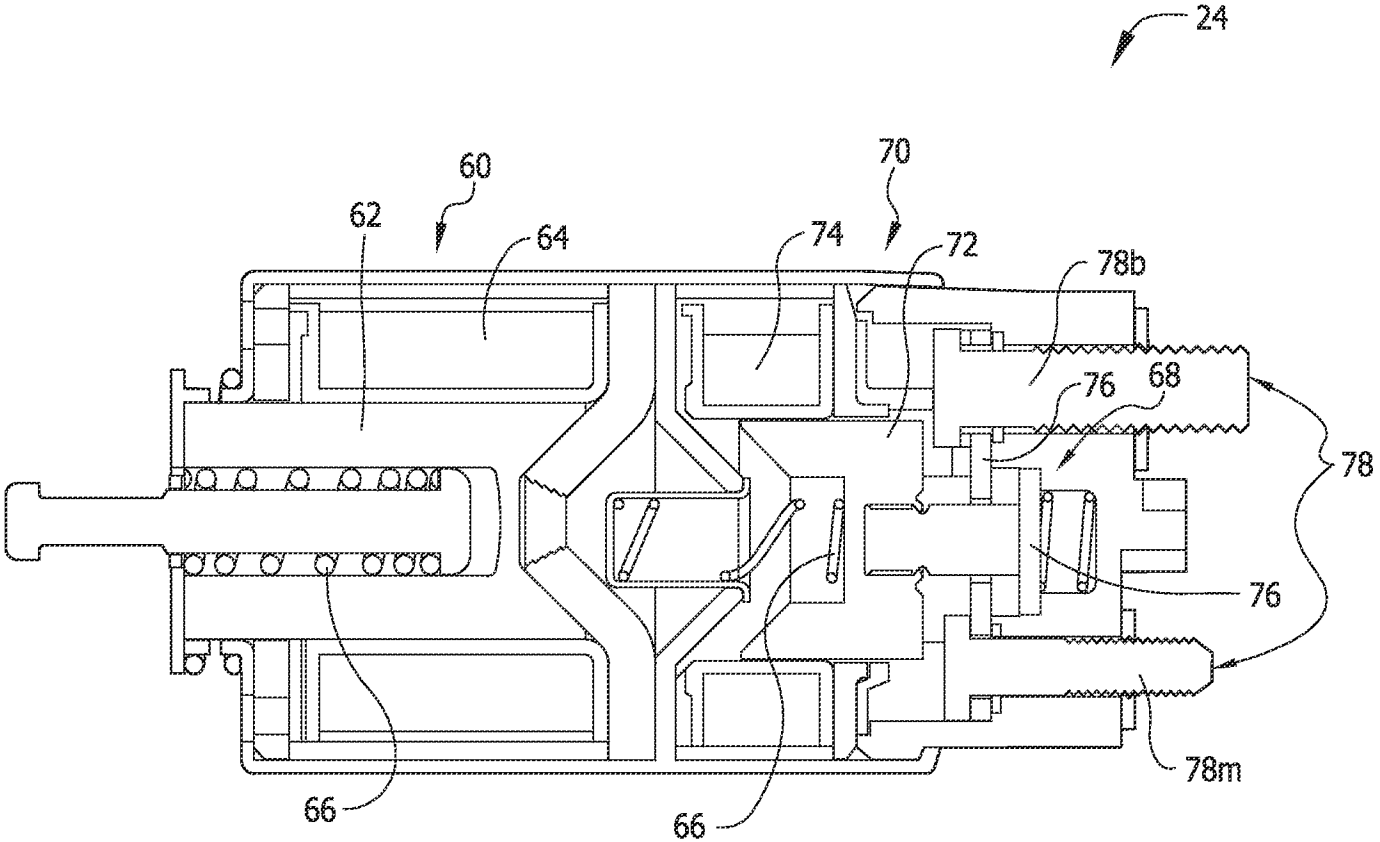
FIG. 2B is a partial view of a second embodiment starter used in the system of FIG. 4, showing a cross-section of its solenoid assembly.

Starter 24 also includes solenoid assembly 60 which acts to drive pinion 44 axially from a retracted state or position (shown in FIG. 2A) in which pinion 44 and engine ring gear 32 are out of engagement, to an extended state or position (shown in FIG. 1) in which pinion 44 and ring gear 32 are engaged. Pinion 44 is biased into its retracted state in a well-known manner. Referring to FIGS. 2A and 2B, first and second embodiment starter 24 each includes solenoid assembly 60. Solenoid assembly 60 includes solenoid plunger 62, solenoid coil 64, and a plurality of biasing members 66 such as springs or other structures capable of biasing portions of solenoid assembly 60 axially towards their respective, normal, de-energized position.

First embodiment starter 24 shown in FIG. 2A includes motor relay switch 68 activated through solenoid assembly 60. In a well-known manner typical of conventional starter systems, motor relay switch 68 is coupled to solenoid plunger 62 and is closed in response to energization of solenoid coil 64, resulting in battery voltage being provided to motor 40. Motor relay switch 68 is biased by a biasing member 66 into an open condition wherein battery voltage is not provided to motor 40. A single, common output signal from ECU 28 thus results both in activation of motor 40, and engagement of pinion 44 and ring gear 32. Second embodiment starter 24 partially shown in FIG. 2B includes solenoid assembly 60, and separably actuated motor relay solenoid assembly 70 having motor relay solenoid plunger 72, motor relay solenoid coil 74, and biasing member(s) 66.

In first or second embodiment starter 24, its motor relay switch 68 includes contactor 76 that is moved axially upon energization of solenoid coil 64 or 74, respectively, into electrical contact with terminals 78 of motor relay switch 68; terminals 78 include battery side terminal 78*b* and motor side terminal 78*m*. Battery 26 is selectively connected to battery side terminal 78*b* of motor relay switch 68, and motor 40 is connected to motor side terminal 78*m* of motor relay switch 68. Movement of motor relay solenoid plunger 72 brings contactor 76 coupled thereto into contact with battery side terminal 78*b* and motor side terminal 78*m* of motor relay switch 68. Terminals 78 are thus shorted through contactor 76, by which battery voltage can be applied to starter motor 40 for energizing the motor and causing it and pinion 44 to spin.

Starter 24 includes shift lever 80. First end 82 of shift lever 80 is coupled to solenoid plunger 62, and second end 84 of shift lever 80 is coupled to pinion 44 and/or clutch 58 and/or first drive shaft 46. The activation of solenoid coil 64 causes solenoid plunger 62 to move axially against the bias of a biasing member 66, which movement is then transferred to pinion 44 via shift lever 80 to move pinion 44 out of its retracted state and towards its extended state, wherein pinion 44 is enmeshed with ring gear 32.

Starter 24 can operate in a generally conventional manner. For example, in response to a signal (e.g., the vehicle driver closing a switch, such as an ignition switch), ECU 28 causes power from battery 26 to be supplied to solenoid assembly 60, causing solenoid plunger 62 to move pinion 44 into engagement with engine ring gear 32 while engine 22 is at rest. This same signal may also cause electrical power from battery 26 to then be supplied to starter motor 40, causing it to generate an electromotive force which is translated through gear train 50 and/or clutch 58 and/or first drive shaft 46 to pinion 44, which is engaged with ring gear 32, thereby cranking engine 22. As a result, engine 22 is started and begins to run without the aid of starter 24, at which time power to starter motor 40 and solenoid 60 is discontinued and pinion 44 is retracted from ring gear 32. Such operation is known as a "cold start," particularly if engine 22 had not been running immediately before coming to rest and being restarted. Typically, cold start operation demands high motor torque and is performed at relatively low motor speeds.

In addition to conventional starting or "cold start" episodes, starter system 20 can be used for other types of engine starting operations. In some embodiments, system 20 can be configured and arranged to enable a "stop-start" starting episode. For example, system 20 can start engine 22 when the engine has already been started and the vehicle continues to be in an active state (i.e., operational), but the engine is temporarily inactivated, as when fuel flow to it has been interrupted and the engine speed has fallen below idle speed to substantially or completely come to rest.

Moreover, in some embodiments, in addition to or in lieu of being configured and arranged to enable a stop-start starting episode, starter system 20 can be configured and arranged to enable a "change-of-mind" type stop-start starting episode. Starter system 20 can start engine 22 when the vehicle continues to be in an active state, the engine has been running, and the engine has been automatically deactivated (e.g., by fuel interruption), but continues to rotate as it decelerates towards rest.

Figure 3:
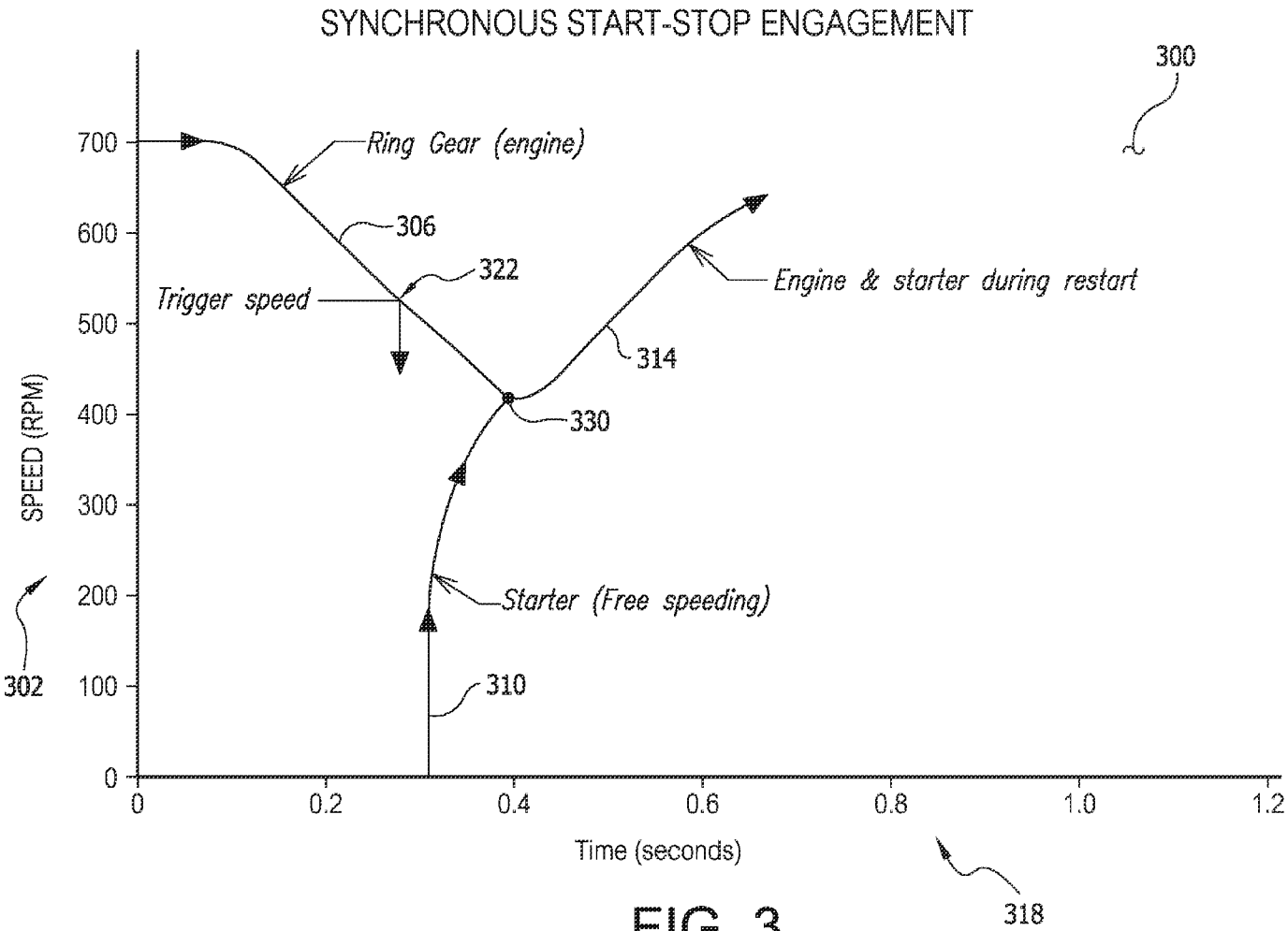
FIG. 3 is a first graph indicating engine ring gear and starter pinion speeds over time during engine restart according to an embodiment of a starter system and method hereby disclosed.

FIG. 3 shows graph 300 representing speeds 302 of engine ring gear 32 along curves 306 and 314, and the speed of starter pinion 44 along curves 310 and 314, over time 318 during a change-of-mind engine restart. As illustrated, following deceleration of engine 22 after shut-down (i.e., after an auto-stop event), engine 22 may be restarted according to at least one embodiment of the invention. FIG. 3 illustrates a change within the first 0.2 seconds from a normal engine idle speed of 700 RPM, to a subsequent, progressive deceleration of engine 22. According to one embodiment of the invention, starter system 20 is configured and arranged to activate the motor coil to spin motor 40 when engine 22 reaches trigger speed 322 below which engine 22 cannot be restarted without help from starter 24; trigger speed 322 may, for example, be 500 RPM. Motor 40 is energized when engine 22 reaches trigger speed 322 and, over a short period of time 318, the speed of motor 40 rises and, at a predetermined time after motor 40 is energized, system 20 activates solenoid coil 64, moving pinion 44 from its retracted state towards its extended state.

Referring to FIG. 3, if, for example, after engine 22 receives a deactivation signal, but before the engine substantially or completely comes to rest, the vehicle driver decides to reactivate the engine (e.g., by removing his foot from the vehicle brake pedal), pinion 44 can engage ring gear 32 at point 330 as the engine coasting. After engaging pinion 44 and rotating ring gear 32, starter 24 then restarts engine 22 by entering a cranking phase. During engine cranking the rotational speeds of the engaged pinion and ring gear increase together and the engine is restarted, at which time the starter and the engine are disengaged by discontinuing power to starter solenoid coil 64. Restarting in such change-of-mind situations may be accomplished by resuming ignition and/or fuel flow at a sufficient engine speed. In some embodiments, system 20 can be configured for other starting episodes, such as a conventional "soft start" starting episodes, wherein motor 40 is at least partially activated during engagement of pinion 44 and ring gear 32, for example.

In order to reduce the potential risk of damage to pinion 44, and/or ring gear 32, the speed of pinion 44 can be substantially synchronized with the speed of ring gear 32 (i.e., the speed of engine 22) when starter 24 attempts to engage pinion 44 with ring gear 32. Thus, starter 24 may also be configured to provide synchronization between pinion 44 and engine ring gear 32. Referring to FIG. 2B, to better facilitate such synchronization during a change-of-mind engine restart, second embodiment starter 24 includes separate pinion solenoid assembly 60 and motor relay solenoid assembly 70, as mentioned above. Motor relay solenoid coil 74 is selectively activated to cause axial movement of motor relay solenoid plunger 72 independently of the axial movement of pinion plunger 62 to effect energization of motor 40. As described above with respect to first embodiment starter 24, the activation of pinion solenoid assembly 60 effects movement of pinion 44 between its retracted and extended states. Thus, in second embodiment starter 12, the rotation of pinion 44 and its engagement with ring gear 32 are individually activated. Generally, the synchronization process occurs as follows: the motor coil 74 is activated first, thereby starting motor 40 rotation, and when the speeds of pinion 44 and ring gear 32 are synchronized, pinion coil 64 is then activated to move pinion 44 out of its retracted state and into its extended state to engage still-rotating ring gear 32. Notably, in some embodiments, there is no requirement to assure that the speeds of pinion 44 and ring gear 32 are synchronized, as pinion 44 may have previously become engaged with ring gear 32 prior to starter system 20 sending a restart signal.

Figure 4:
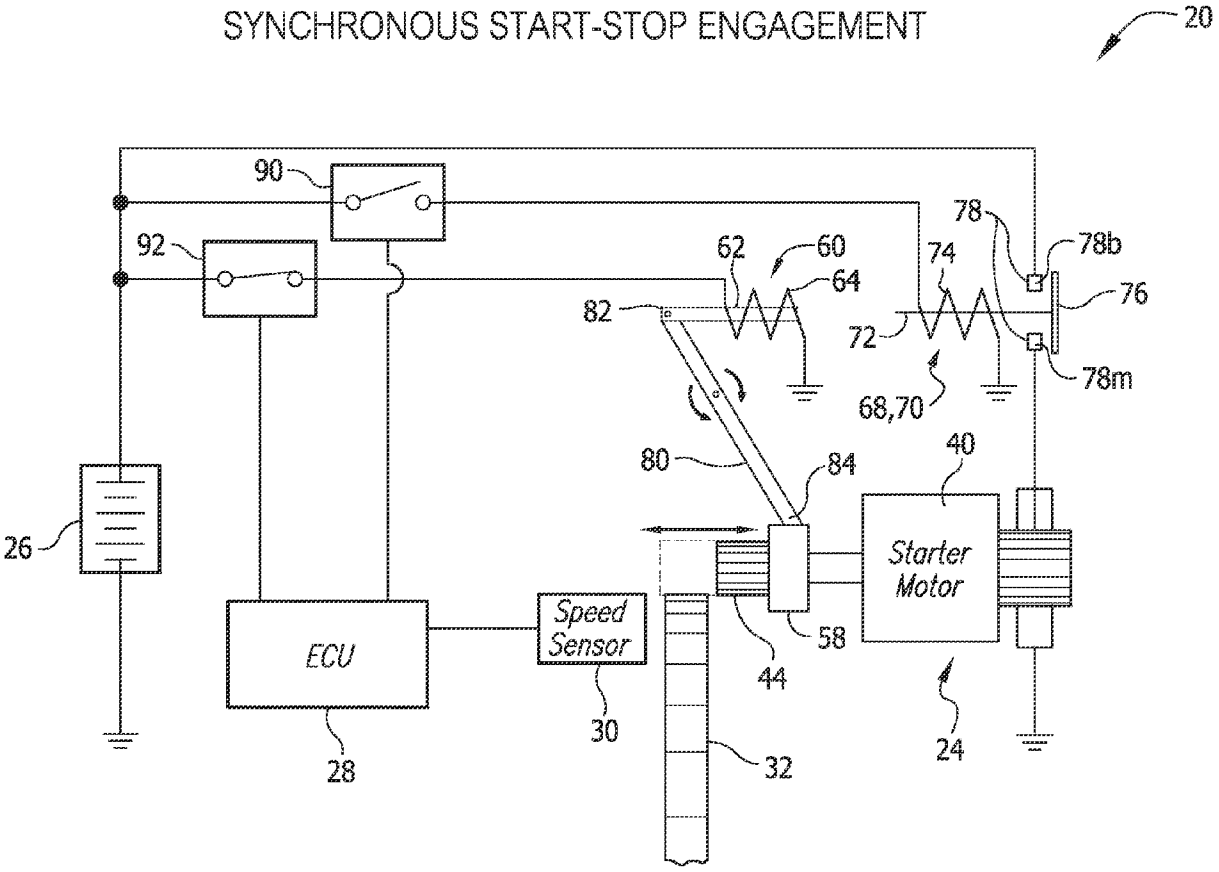
FIG. 4 is a diagram of a second embodiment starter system according to the present disclosure.

FIG. 4 is a diagram representing a portion of second embodiment starter system 20 that includes second embodiment starter 24 and which is configured and arranged such that its ECU 28 selectively closes motor switch 90 to place motor 40 in communication with battery 26 through motor relay switch 68. ECU 28 also selectively closes pinion switch 92 to place coil 64 of pinion solenoid assembly 60 in communication with battery 26, which moves pinion solenoid plunger 62 against biasing members 66 to move pinion 44 out of its retracted state and towards its extended state. As discussed above, sensor 30 is provided for detecting the position of ring gear 32 and providing a signal to ECU 28 for determining engine speed. The variable speed of ring gear 32 is therefore continuously monitored and is determinable to system 20.

Figure 5A:
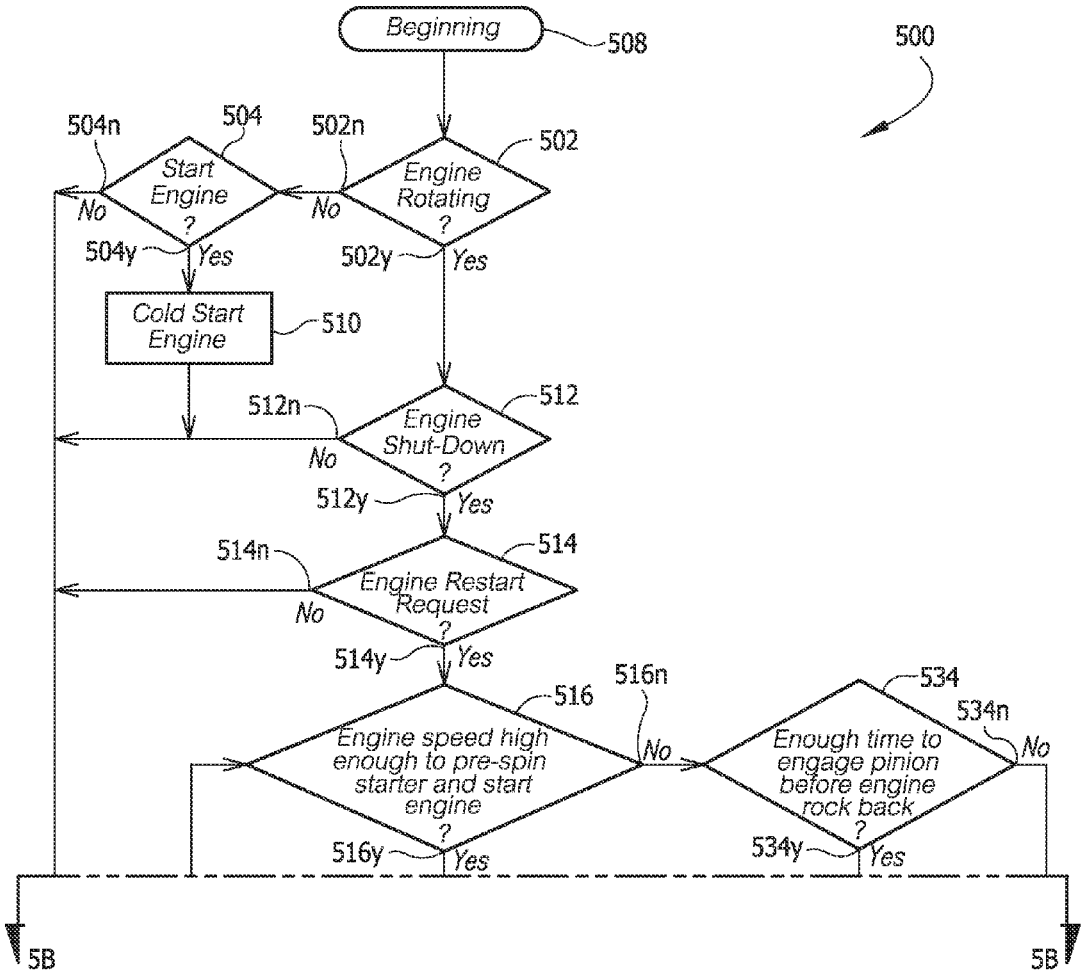
FIGS. 5A and 5B, collectively referred to herein as FIG. 5, depict a flowchart of process steps of a starter system control process according to the present disclosure.
Figure 5B:
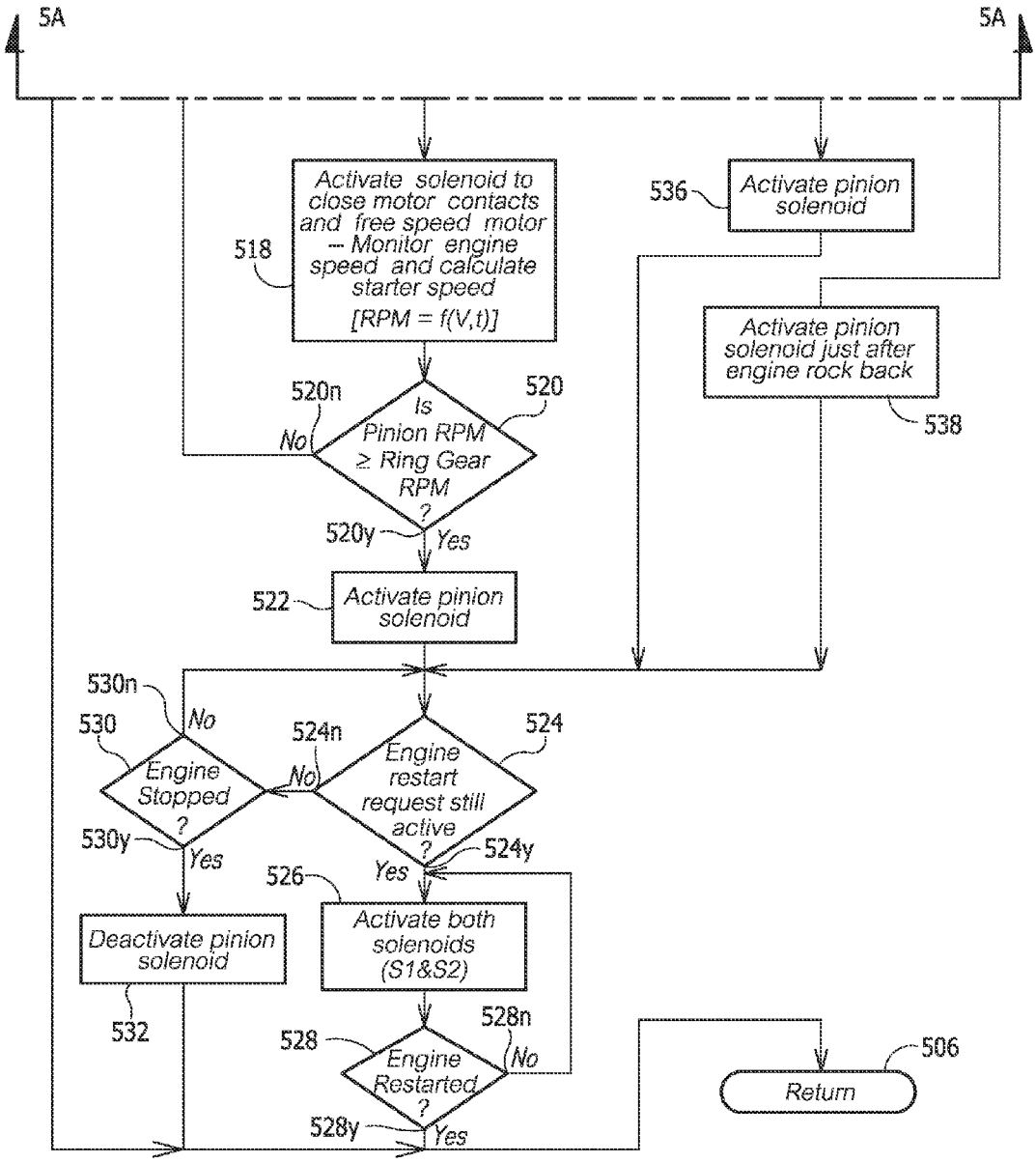

FIG. 5 is a flow chart indicating steps in process 500 carried out by one or more embodiments of starter system 20. In the following discussion, the respective "yes" or "no" outcome of each decision or determination in FIG. 5 is also identified with an associated y or n reference numeral suffix, respectively. ECU 28 is configured and arranged to determine, at 502, whether engine 22 is rotating.

If, at 502, ECU 28 determines that engine 22 is not rotating 502*n* and therefore is at rest, ECU 28 then determines at 504 whether engine 22 is to be started.

If, at 504, it is determined that nonrotating engine 22 is not to be started 504*n*, process 500 returns, at 506, to beginning 508. If, at 504, it is determined that nonrotating engine is to be started 504*y*, system 20 then proceeds with a cold start operation 510 as described above, wherein engine 22 is cranked from a rest and subsequently started. Notably, system 20 may engage pinion 44 with ring gear 32 after engine 22 comes to rest to subsequently facilitate a quicker cold start if the vehicle is operational.

If, at 502, it is determined that engine 22 is rotating 502*y* and therefore not at rest, ECU 28 determines, at 512, whether an engine auto-stop shutdown event has occurred or stop-start mode has been entered.

If, at 512, it is determined that an engine stop-start mode has not been entered 512*n*, process 500 returns, at 506, to beginning 508 and system 20 continues monitoring for a stop-start mode condition. If, at 512, it is determined that an engine stop-start mode has been entered 512*y*, ECU 28 determines, at 514, whether an engine restart request has been issued.

If, at 514, it is determined that an engine restart request has not been issued 514*n*, process 500 returns, at 506, to beginning 508. If, at 514, it is determined that an engine restart request has been issued 514*y*, then, at 516, ECU 28 determines whether the speed of engine 22 is high enough to allow starter motor pre-spin in preparation for pinion 44 to engage rotating ring gear 32 and starter 24 to crank engine 22.

If, at 516, it is determined that engine speed is of sufficient magnitude to allow starter motor pre-spin in preparation for pinion 44 to engage rotating ring gear 32, 516*y*, then, at 518, motor switch 90 is closed and contactor 76 of motor relay switch 68 shunts terminals 78, whereby battery voltage is applied to starter motor 40, energizing the motor and causing it to begin spinning. ECU 28 continuously monitors the rotational speed of engine 22 while also determining the speed of pinion 44. In some embodiments of system 20, the speed of pinion 44 is determined by monitoring the voltage of battery 26 as a function of time after battery voltage is applied to motor 40, and applying a measured curve fit of the speed of motor 40 during its acceleration. Although the rotational speed of pinion 44 as a function of time can be theoretically modeled, experimental analysis of a motor 40 followed by curve fitting of the response has yielded a more accurate result. The speed of motor 40, and thus the speed of pinion 44, varies as a function of time and applied voltage. If the time t elapsed since motor activation is less than 0.3 seconds (t<0.3 seconds), the expression set out in closed-form quartic equation (1) has been found useful for calculating the speed of pinion 44:

$$\text{pinion speed}=-108752\cdot(V-0.9)/(12-0.9)\cdot t^4+283908\cdot(V-0.9)/(12-0.9)\cdot t^3-166874\cdot(V-0.9)/(12-0.9)\cdot t^2+38127\cdot(V-0.9)/(12-0.9)\cdot t-95 \quad (1)$$

where V is the actual applied motor voltage and the resulting pinion speed is in RPM at a 1:1 motor-to-pinion speed ratio within starter 24. If time t elapsed since motor activation is greater than or equal to 0.3 seconds (t≥0.3 seconds), then the pinion speed is a constant, predetermined level presumed to be about 3109 RPM.

Alternatively, in some embodiments of system 20, the control circuit of ECU 28 can perform a running evaluation of pinion speed by updating the result (i.e., the predicted speed of the starter pinion) over a continual series of small, discreet time steps each of duration t. In other words, a step-by-step evaluation of pinion speed would continue whereby the predicted pinion speed is determinable based on dynamic applied motor voltage (which changes with time) and time. For example, starting at the initial time step of duration t immediately following motor energization, ECU 28 can calculate the pinion speed over this time step based on either the average, the starting, or the final applied motor voltage during this time step. Each time step t, which is the ECU's pinion speed update interval, will be small; therefore, the stepped error will be also be small. Over each subsequent time step the ECU would compute the new pinion speed based on the initial pinion speed of that respective time step. This process continues for each of the series of discreet time steps, and a running evaluation of pinion speed based on equation (1) is obtained based on small, discreet time steps t, with the resulting speed of each step added to the speed calculated in the respective, immediately prior time step. Thus, the speed of pinion 44 at a particular time after motor energization is calculated in a manner to account for time-varying voltage.

Following step 518, ECU 28 then, at 520, compares the relative speeds of pinion 44 and ring gear 32 and determines whether the speed of pinion 44, which may be calculated by an above-described method, is greater than or equal to the speed of ring gear 32. If, at 520, it is determined that the speed of pinion is not at least that of ring gear 32, 520*n*, process 500 returns to above-described step 516, wherein ECU 28 again determines whether the engine speed is high enough to pre-spin starter motor 40 in preparation for engaging pinion 44 with still-rotating ring gear 32. If, at 520, it is determined that the speed of pinion is at least that of ring gear 32, 520*y*, pinion 44 is ready to engage ring gear 32 and begin cranking engine 22, and pinion solenoid assembly 60 is activated at step 522, thereby moving rotating pinion 44 from its retracted state towards its extended state.

In the embodiment of system 20 shown in FIG. 4, which employs second embodiment starter 24, ECU 28 is configured and arranged to separately regulate the current flows through pinion solenoid coil 64 of pinion solenoid assembly 60, and motor relay solenoid coil 74 of motor relay solenoid 70. For example, ECU 28 can comprise, or be in communication with, pinion switch 92 through which pinion solenoid assembly 60 is operated in a substantially "on-off" fashion, with pinion switch 92 at least partially regulating current flow to pinion solenoid coil winding 64. Upon receiving such an "on" signal from ECU 28, pinion switch 92 is closed, at 522 of FIG. 5, to energize pinion solenoid coil winding 64, which results in pinion solenoid plunger 62 moving against its biasing member 66. Such movement of pinion solenoid plunger 62 effects movement of shift lever 80, which in turn effects the movement of pinion 44 out of its retracted state, in which it is out of engagement with ring gear 32, and towards its extended state, in which it is enmeshed with ring gear 32. Pinion 44 thus becomes engaged with ring gear 32 at step 522. Process 500 then continues to step 524, at which ECU 28 determines whether the engine restart request is still active.

If, at 524, it is determined that the engine restart request is still active 524*y*, ECU 28 continues battery voltage application to both motor switch 90 and pinion switch 92 at step 526, resulting in continued rotation and/or acceleration of motor 40 and cranking of engine 22. At 528, ECU 28 subsequently determines whether engine 22 has restarted. If, at 528, it is determined that engine 22 has not restarted 528*n*, process 500 returns to 526 and ECU 28 continues applying battery voltage to both motor switch 90 and pinion switch 92. If, at 528, it is determined that engine 22 has restarted 528*y*, process 500 returns at 506 to beginning 508.

If, at 524, it is determined that the engine restart request is not still active 524*n*, ECU 28 determines, at 530, whether engine 22 has stopped, i.e., come to rest. If, at 530, it is determined that engine 22 has not stopped and is still rotating 530*n*, process 500 returns to above-discussed step 524 wherein it is determined whether the engine restart request is still active. If, at 530, it is determined that engine has come to rest 530*y*, ECU 28 opens pinion switch 92 at step 532, deactivating pinion solenoid assembly 60, and process 500 then returns, at 506, to beginning 508.

Some embodiments of system 20 alternatively operate to provide synchronous stop-start engagement of starter 24 and ring gear 32 if ECU 28 determines that a stop-start mode has been initiated 512*y* on the basis of data received from ring gear position sensor 30 and used, if an engine restart request has been issued 514*y*, to determine at 516 whether the speed of engine 22 is high enough to allow starter pre-spin in preparation to crank the engine. If, at 516, it is determined that the engine speed is high enough to allow starter pre-spin in preparation for cranking the still-rotating engine 516*y*, the consequent steps of process 500 are those described above. If, however, at 516, ECU 28 determines that the speed of engine 22 is not high enough to allow starter 24 pre-spin 516*n*, ECU 28 then determines, at 534, whether there is sufficient time to engage pinion 44 and ring gear 32 prior to rock-back of engine 22.

If, at 534, it is determined that that there is sufficient time to engage pinion 44 and ring gear 32 prior to rock-back of engine 22, 534*y*, pinion solenoid assembly 60 is activated at 536. If, at 534, it is determined that that there is not sufficient time to engage pinion 44 and ring gear 32 prior to rock-back of engine 22, 534*n*, pinion solenoid assembly 60 is activated immediately after engine rock-back, at 538, when engine 22 is at rest. Following step 536 or 538, process 500 then proceeds to above-described step 524 wherein it is determined whether the engine restart request is still active. The above-described steps consequent to 524*y* or 524*n* then follow.

Figure 6:
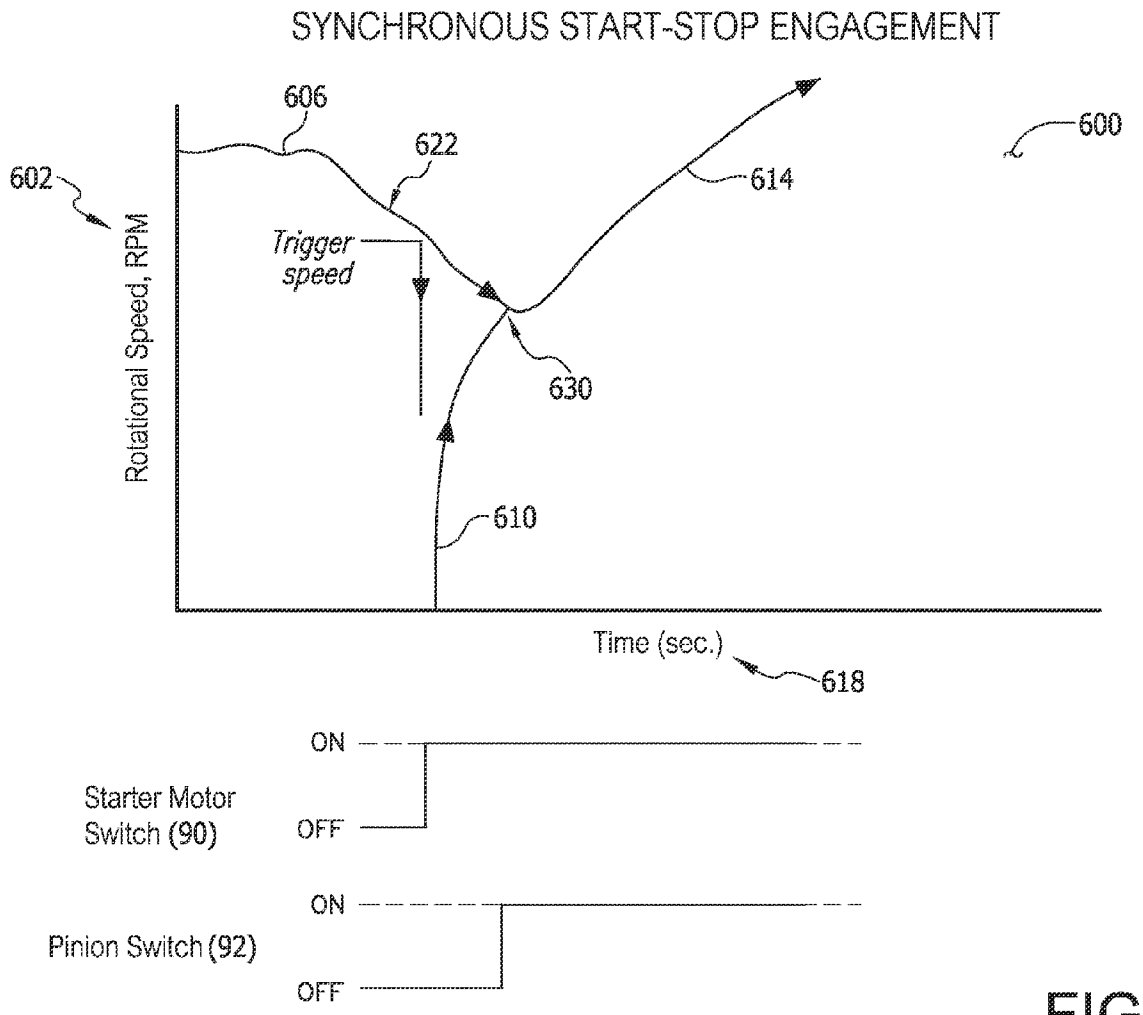
FIG. 6 is a second graph indicating engine ring gear and starter pinion speeds, and states of the starter motor and starter solenoid switches, over time during engine restart according to an embodiment of a starter system and method hereby disclosed.

FIG. 6, which is similar to FIG. 3, shows graph 600 representing speeds 602 of engine ring gear 32 along curves 602 and 614, and the speed of starter pinion 44 along curves 610 and 614, over time 618. Graph 600 also indicates the corresponding times at which motor switch 90 (and motor relay solenoid assembly 70) and pinion switch 92 (and pinion solenoid assembly 60) change between their respective off and on states, i.e., the times at which the respective switches are open or closed, respectively. Following engine deceleration from idle speed after occurrence of an engine auto-stop event, engine 22 may be restarted as illustrated. FIG. 6 illustrates that during the first 0.2 seconds of a deceleration from a normal engine idle speed of about 700 RPM, motor switch 90 and pinion solenoid switch 92 are in their off states, (i.e., the switches are both open). If an engine restart request is present, motor switch 90 is turned on or closed by ECU 28 when ring gear 32 reaches threshold or trigger speed 622, and battery voltage is applied to motor relay coil 74, thereby energizing motor 40. Trigger speed 622 is that at which engine 22 cannot restart itself without help from starter 24; trigger speed 622 may be, for example, 500 RPM. Motor 40 accelerates and engine 22 further decelerates over a short period of time and, at a predetermined elapsed time thereafter pinion switch 92 is turned on or closed by ECU 28, and battery voltage is applied to pinion solenoid coil 64 of pinion solenoid assembly 60, which immediately moves pinion 44 form its retracted position and towards its extended position, in which it engages engine ring gear 32.

For various reasons, in some cases it may not be required that starter system 20 assure that the speeds of rotating starter pinion 44 and rotating ring gear 32 be synchronized at the time of their engagement. For example, pinion 44 may have become engaged with ring gear 32 prior to issuance of the engine restart request signal. However, once starter 24 and engine 22 are engaged, at point 630, and engine 22 is being cranked, the rotational speed of the engine increases or is maintained under urging of starter 24 until restart occurs, with the ring gear and pinion both following curve 614 in FIG. 6.

Figure 7:
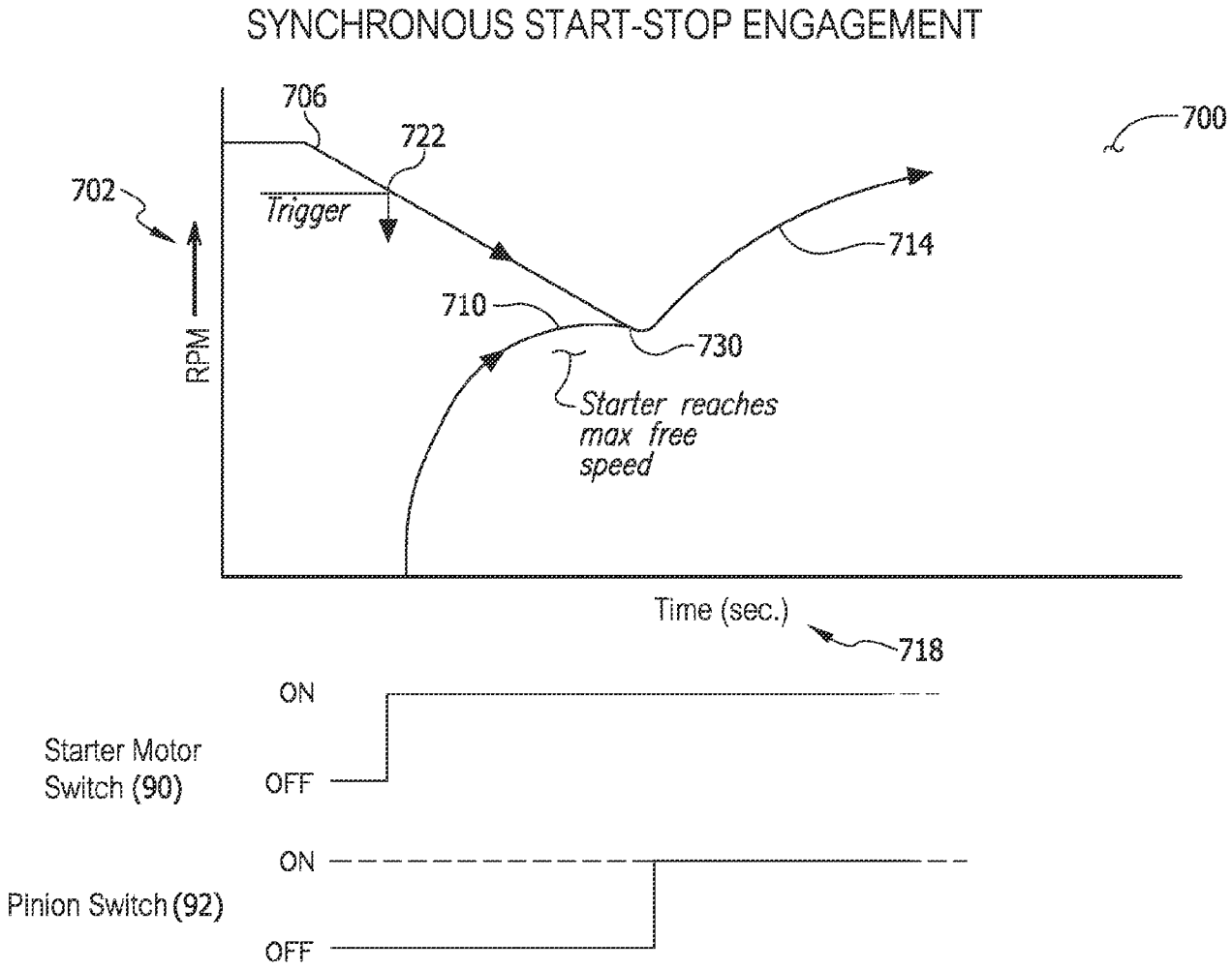
FIG. 7 is a third graph indicating engine ring gear and starter pinion speeds, and states of the starter motor and starter solenoid switches, over time during engine restart according to an embodiment of a starter system and method hereby disclosed.

FIG. 7, which is similar to FIG. 6, shows graph 700 representing the speeds 702 of engine ring gear 32 along curves 706 and 714, and the speed of starter pinion 44 along curves 710 and 714, over time 718. Graph 700 also indicates the corresponding times at which motor switch 90 (and motor relay solenoid assembly 70) and pinion switch 92 (and pinion solenoid assembly 60) change between their respective off and on states, i.e., the times at which the respective switches are open or closed, respectively. Following engine deceleration from a normal idle speed after occurrence of an engine auto-stop event, engine 22 may be restarted as illustrated. FIG. 7 shows the change from a normal idle speed of about 700 RPM, and a subsequent deceleration. At this time, switches 90 and 92 are initially in their off states (i.e., the switches are both open). An embodiment of starter system 20 can be configured and arranged to activate motor solenoid coil 74 to spin starter motor 40 if an engine restart request is present, when the engine speed decelerates to threshold or trigger speed 722 at or below which engine 22 cannot restart itself without help from the starter 24. When engine 22 reaches trigger speed 722, which may, for example, be 500 RPM, motor switch 90 is closed and battery voltage applied across to motor relay switch 68, resulting in motor 40 being energized as discussed above. Over a short period of time after motor 40 is energized, its speed rises and, when starter 24 reaches a maximum free rotational speed along curve 710, system 20 closes pinion switch 92, which applies battery voltage to pinion solenoid coil 64. Consequently, pinion 44 is immediately brought into engagement with ring gear 32 at point 730. Once starter 24 and engine 22 are engaged, the engine enters a cranking phase in which rotational speed of engine 22 increases under urging of starter 24 until engine restart occurs, with the engine and starter speeds indicated along curve 714 in FIG. 7.

In some embodiments, system 20 is configured and arranged such that if, upon issuance of an engine restart request after engine shut-down, the engine speed is determined to not be high enough to pre-spin motor 40 for restarting the decelerating engine, ECU 28 subsequently applies a control algorithm based on the status of engine rock-back, a state in which the engine is rotating at a slow rate of speed in an direction opposite to that of normal operation before coming to rest. Engine rock-back occurs because of the re-expansion of gases compressed in at least one engine cylinder.

Figure 8:
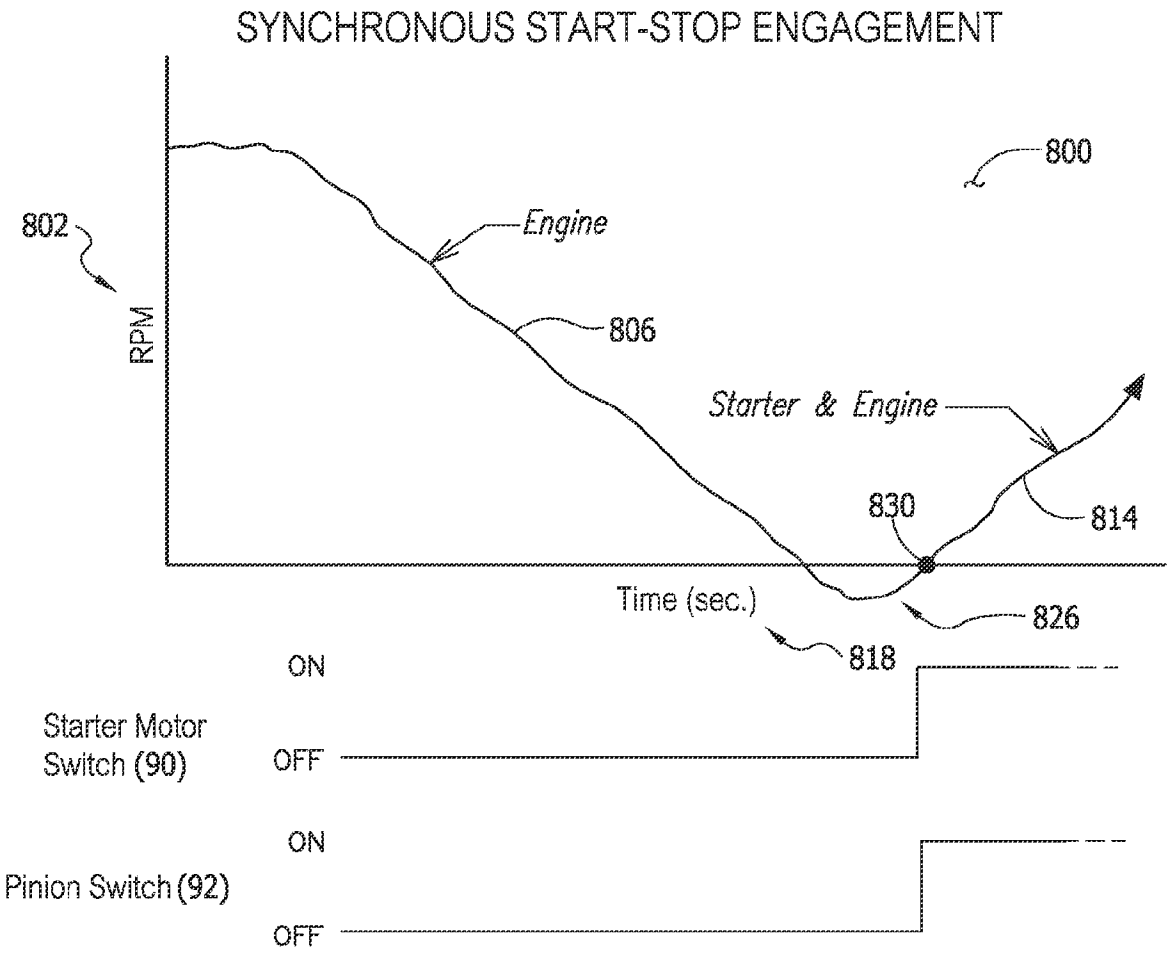
FIG. 8 is a fourth graph indicating engine ring gear and starter pinion speeds, and states of the starter motor and starter solenoid switches, over time during engine restart according to an embodiment of a starter system and method hereby disclosed.

FIG. 8 provides a graphical representation of engine and starter speeds during engine shutdown and restart under an engine rock-back scenario. Graph 800 shows the speeds 802 of engine ring gear 32 along curves 806 and 814, and the speed of starter pinion 44 along curve 814, over time 818. Graph 800 also indicates the corresponding times at which motor switch 90 (and motor relay solenoid assembly 70) and pinion switch 92 (and pinion solenoid assembly 60) change between their respective off and on states, i.e., the times at which the respective switches are open or closed, respectively. FIG. 8 shows the speed of ring gear 32 changing from a normal idle speed of, for example, about 700 RPM, through a subsequent deceleration after engine shutdown, to engine rock-back event 826. As described earlier, if an engine restart request exists and ECU 28 determines there is not sufficient time to engage pinion 44 and ring gear 32 prior to engine rock-back (see 534*n* in FIG. 5), ECU 28 activates pinion solenoid assembly 60 once engine 22 comes to rest immediately after engine rock-back, at point 830 of FIG. 8, at which point pinion 44 and ring gear 32 become enmeshed. Referring again to FIG. 5, ECU 28 then determines, at 524, whether the engine restart request is still active. If, at 524, it is determined that the engine restart request is still active, 524*y*, ECU 28 closes motor switch 90 and pinion switch 92 substantially simultaneously, applying battery voltage to both motor relay solenoid coil 74 and pinion solenoid coil 64, resulting, at point 830 of graph 800, in the engagement of pinion 44 and ring gear 32 and the start of rotation, and the continued acceleration (to a speed no greater than a presumed predetermined, maximum speed), of enmeshed pinion 44 and ring gear 32 along curve 814 and the subsequent starting of engine 22. Steps of process 500 consequent to ECU 28 determining, at 524, that the engine restart request is not still active 524*n* are described above. Notably, restarting of engine 22 in this manner after encountering engine rock-back event 826 may be accomplished utilizing first or second embodiment starter 24, and is similar to a cold start event.

As mentioned above, in some embodiments of system 20 a comparison of stator pinion and ring gear speeds is made by ECU 28 to synchronize the speed of starter 24 with the speed of the decelerating ring gear 32, the latter of which is determinable from the signals received from sensor 30 by ECU 28. In such embodiments, synchronous engagement of starter pinion 44 and ring gear 32 may be achieved by intermittently applying and discontinuing battery voltage to starter motor 40, causing the speed of pinion 44 to increase and decrease in a predictable manner to substantially match the speed of ring gear 32; once their speeds are matched, pinion 44 is moved from its retracted state into its extended state and smoothly engages ring gear 32, and starter 24 may then crank engine 22 to a speed at which the engine is restarted. The rotational speed of an energized starter motor 40 of the size of most interest for a starter 24 included in the various embodiments of system 20, will accelerate and decelerate in a predictable manner as electrical power to it is intermittently applied and discontinued.

Figure 9:
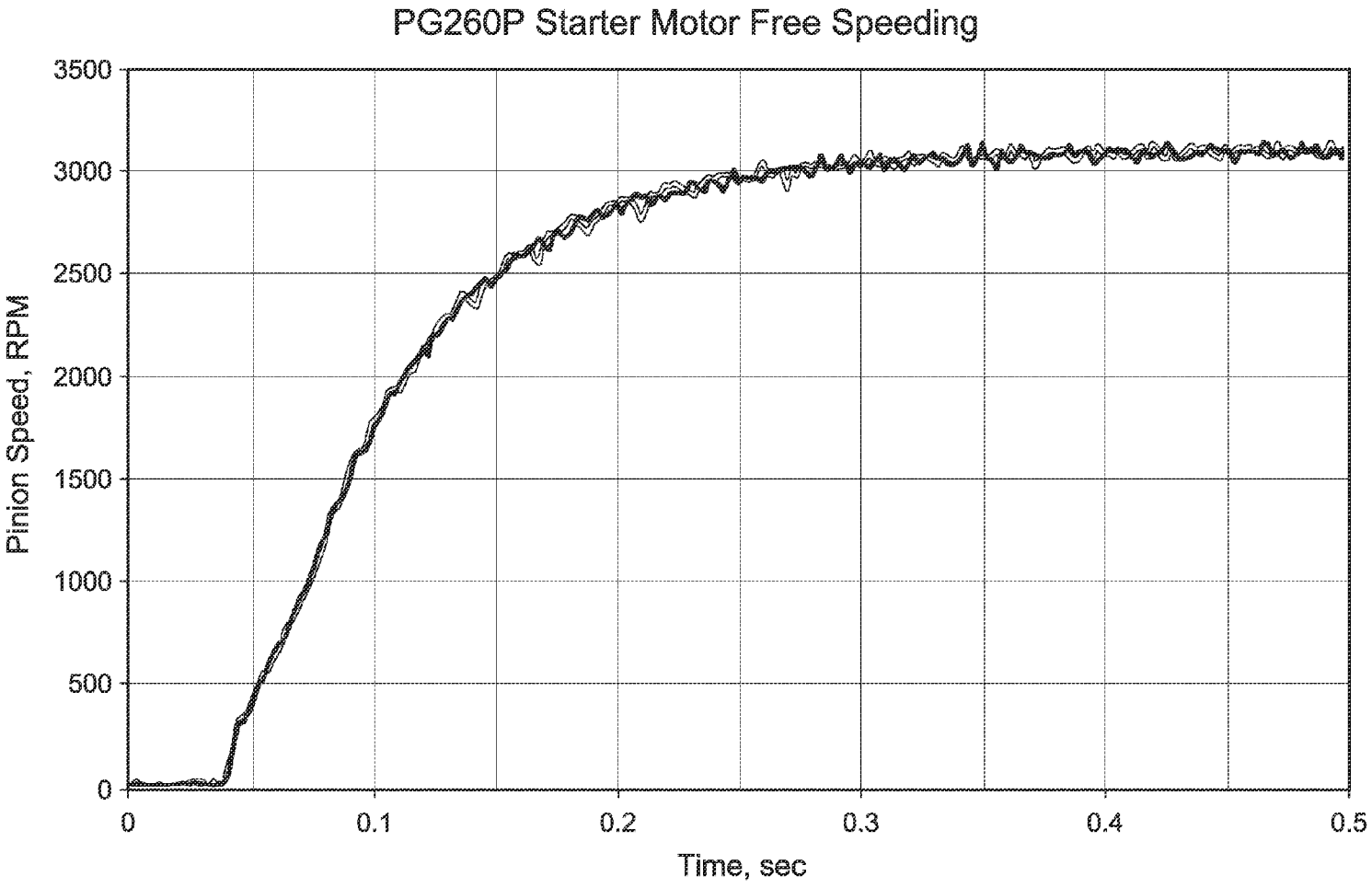
FIG. 9 is a graph of starter pinion speeds over time during free speeding accelerations of starter motors.
Figure 10:
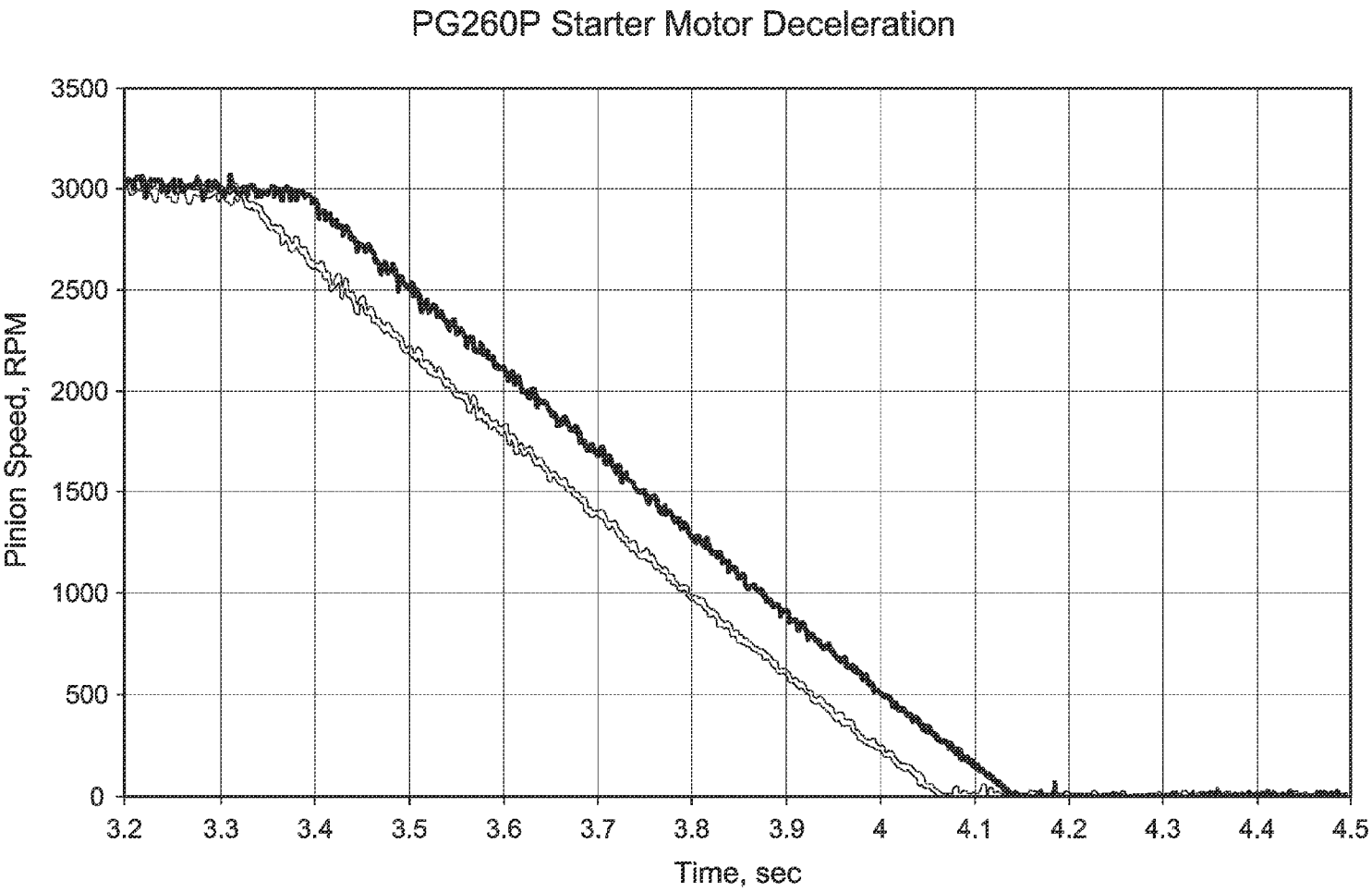
FIG. 10 is a graph of starter pinion speeds over time during decelerations of starter motors.

FIG. 9 shows the rotational speed of pinions 44 of such starters 24 during free speeding of their starter motors 40, subsequent to motor energization at a given voltage level. As represented by the test data shown in FIG. 9, the acceleration rates of these motors 40 are substantially consistent. Pinions 44 of such starters 24 have also been shown to consistently decelerate at a substantially uniform and linear rate once power to their motors 40 is discontinued, as represented by the test data shown in FIG. 10. Thus, the speed of unloaded pinion 44 is demonstrably predictable as a function of time. If, for example, after energization of motor 40 the speed of starter pinion 44, determinable by the elapsed time after motor energization, climbs to a level that is higher than the monitored speed of ring gear 32, ECU 28 can open motor switch 90, thereby de-energizing motor coil 74 and causing motor relay switch 68 to open, which interrupts the power application to motor 40 and causes rotation of pinion 44 to decelerate in a predictable manner to a speed determinable by the elapsed time after motor de-energization. Intermittent applications of power to motor 40, repeatedly if necessary, can thus synchronize the speeds of pinion 44 and ring gear 32. Once their speeds are suitably matched, these gears may be smoothly engaged and engine cranking thereafter performed.

As mentioned above, the rotational speed of pinion 44 can also be modeled. In some embodiments of starter system 20, ECU 28 can perform an integration of the speed of pinion 44 to account for time-varying voltage, and this information can be used by starter system 20 to control various switches and solenoids to implement a synchronous engagement of starter pinion 44 and engine ring gear 32. The speed of starter motor 40 can be determined by evaluating the voltage as a function of time applied to the motor, along with a measured curve fit of motor acceleration. For example, FIG. 11 shows a computed rotational speed of pinion 44 according to one exemplary embodiment of system 20, wherein, if the time t elapsed since motor activation is less than 0.3 seconds (t<0.3 seconds), the speed y of pinion 44 in RPM is calculated by ECU 28 as a function of time by the formula set out in closed-form quartic equation (2):

$$y=-108752\cdot t^4+283908\cdot t^3-166874\cdot t^2+38127\cdot t-95 \quad (2)$$

Figure 11:
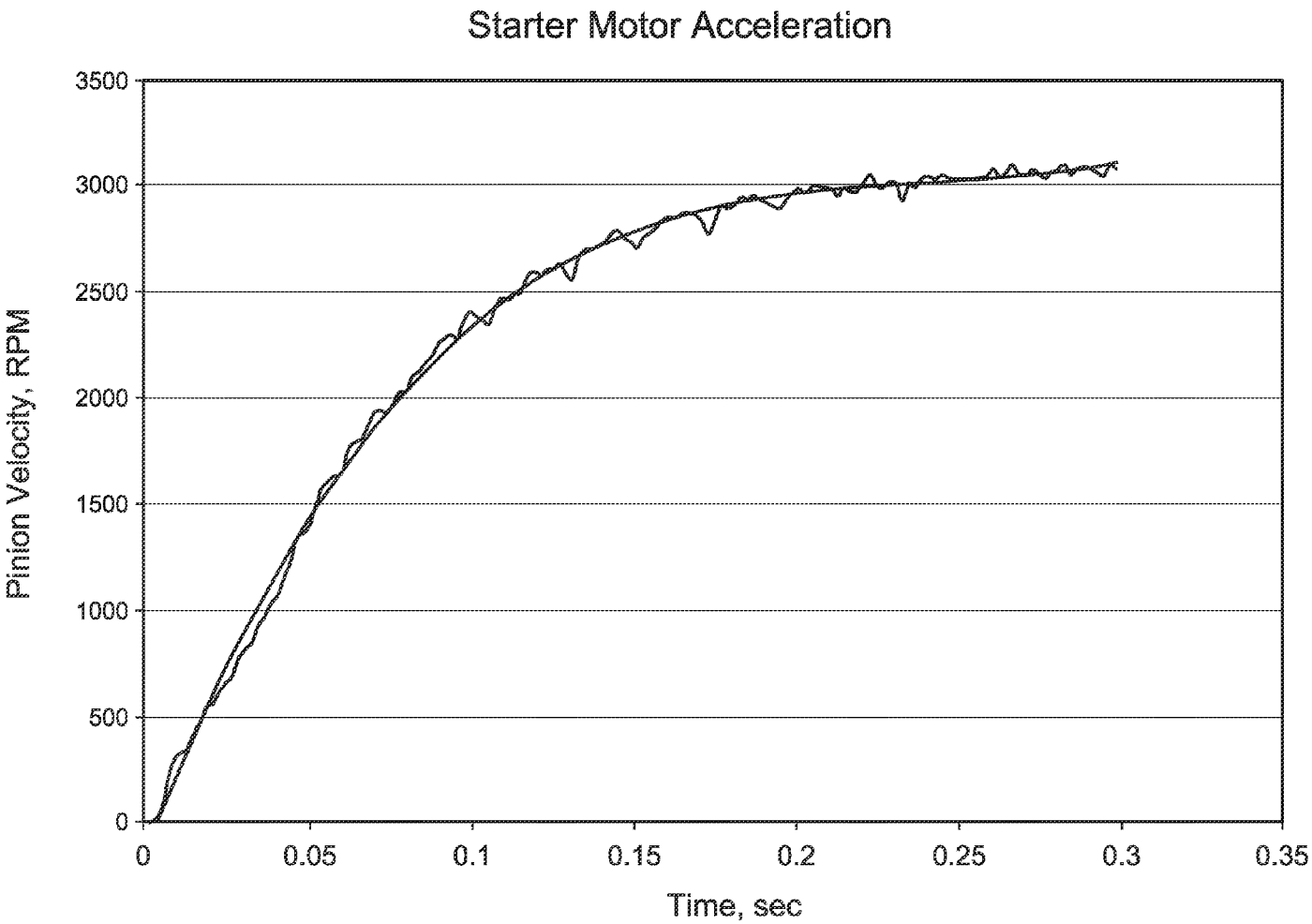
FIG. 11 is a graph of starter pinion speeds computed according to the present disclosure superimposed upon a graph of measured starter pinion speeds over time during accelerations of starter motors.

As FIG. 11 shows, the smooth curve fit line closely correlates to the pinion speed data obtained from testing, with a statistical coefficient of determination (known by those skilled in the art as $R^2$) of 0.9975. If time t elapsed since motor activation is greater than or equal to 0.3 seconds (t≥0.3 seconds), then the pinion speed is a constant, predetermined level presumed to be about 3109 RPM. Furthermore, the speed y of pinion 44 in RPM also varies as a function of voltage applied to starter motor 40, which, for t<0.3 seconds, leads to the formula set out in closed-form quartic equation (3):

$$y=-108752\cdot(V-0.9)/(12-0.9)\cdot t^4+283908\cdot(V-0.9)/(12-0.9)\cdot t^3-166874\cdot(V-0.9)/(12-0.9)\cdot t^2+38127\cdot(V-0.9)/(12-0.9)\cdot t-95 \quad (3)$$

in which V is the actual applied motor voltage and t, as above, is the time elapsed in seconds since motor activation. As indicated above, if time t elapsed since motor activation is greater than or equal to 0.3 seconds (t≥0.3 seconds), then the pinion speed is a constant, predetermined level presumed to be about 3109 RPM.

In other embodiments of starter system 20, ECU 28 can perform an incremental evaluation of the speed of pinion 44 in a manner similar to that described above to account for time-varying voltage. That is, the control circuit of ECU 28 can perform a running evaluation of pinion speed by updating the result (i.e., the predicted speed of the starter pinion) over a continual series of small, discreet time steps each of duration t. A step-by-step evaluation of pinion speed would continue whereby the predicted pinion speed is determinable based on dynamic applied motor voltage (which changes with time) and time. As described earlier, starting at the initial time step of duration t immediately following motor energization, ECU 28 can calculate the pinion speed over this time step, and, over each subsequent time step, the ECU would compute the new pinion speed based on the initial pinion speed of that respective time step, with the resultant speed added to that calculated for the immediately prior time step. This process continues for each of the series of discreet time steps, and a running evaluation of pinion speed is therefore obtained incrementally on the basis of small, discreet time steps. Thus, the speed of pinion 44 at a particular time after motor energization is calculated in a manner to account for time-varying voltage.

Figure 12:
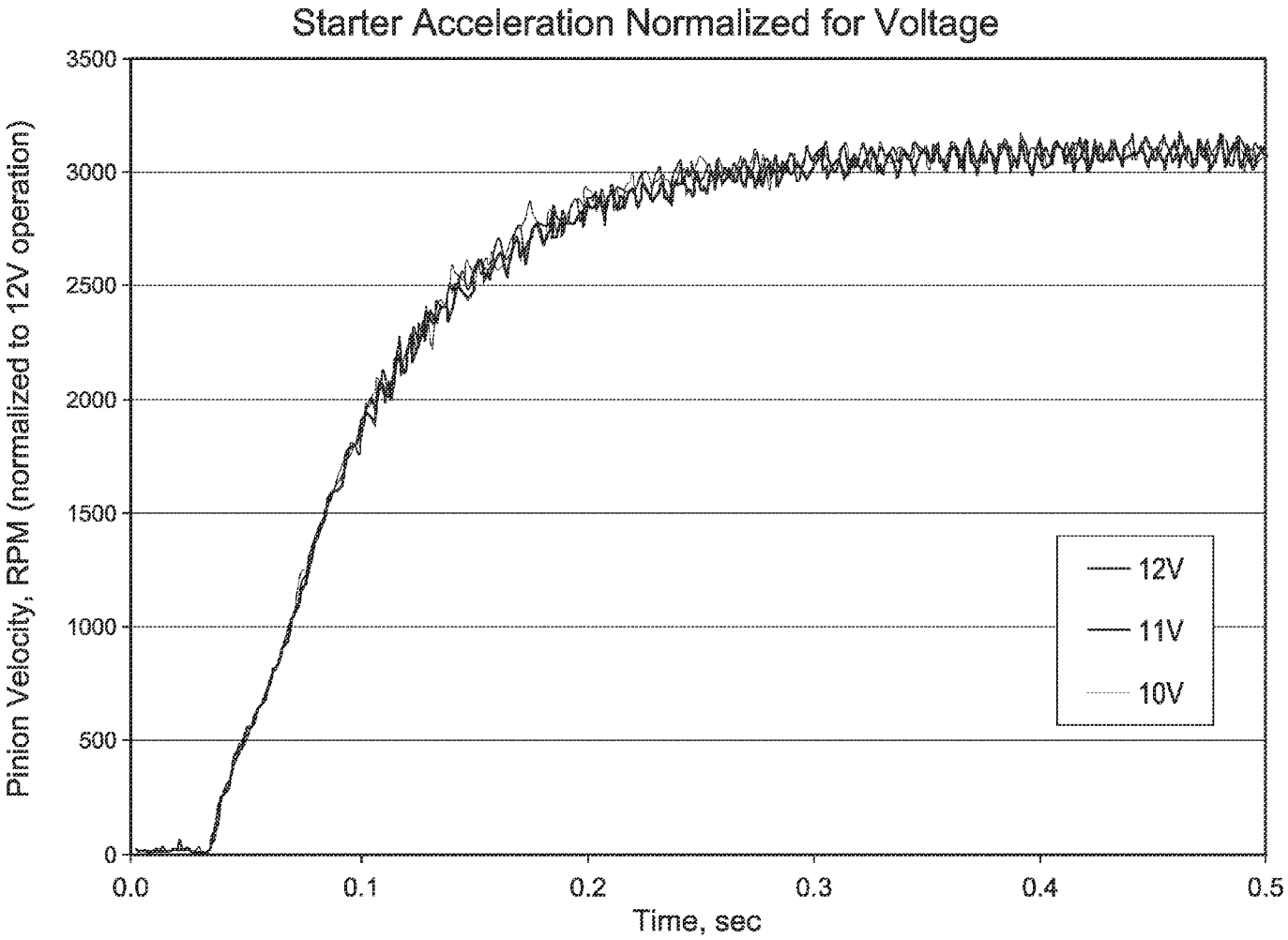
FIG. 12 is a graph of starter pinion speeds over time during free speeding accelerations of a starter motor operated at 10V, 11V, and 12V.

Furthermore, the time-varying voltage can be accurately modeled as demonstrated by the overlapping curves for 12V, 11V, and 10V voltage variations shown in FIG. 12. In some embodiments as shown, the individual curves for the rotational speed of pinion 44 substantially overlap, demonstrating the accuracy of the model at various voltages applied to motor 40. In FIG. 12, the three curves (each representing a run at one of three different applied voltages) lay on top of each other when normalized to 12V operation, indicating that the effects of voltage variation on starter speed can be accurately modeled.

Figure 13:
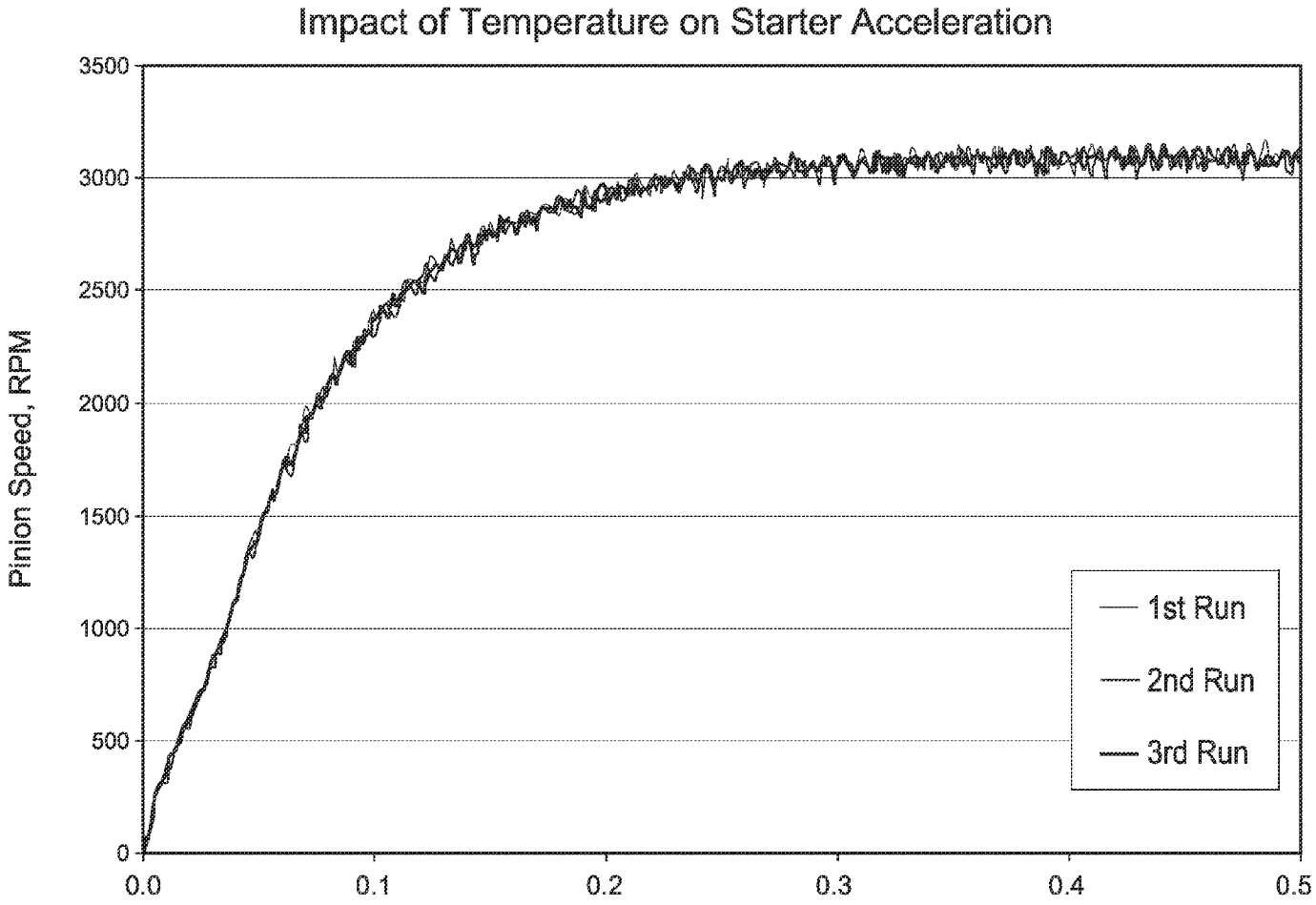
FIG. 13 is a graph of starter pinion speeds over time during free speeding accelerations of a starter motor over three consecutive cycles, showing temperature effects on starter motor acceleration.

Moreover, as shown in FIG. 13, the accuracy of the model is not significantly affected by changes in starter motor temperature. As depicted, modeled data for pinion speed over three separate runs demonstrates that the models substantially overlap and are not significantly affected by temperature. The test was conducted by consecutively running a starter motor 40 for three (3) cycles, each of three (3) seconds on and two (2) seconds off, during which time the temperature of the copper windings in motor 40 would have been raised by 20-50° C. and the temperature of its motor brushes would have been raised by 50-100° C. In FIG. 13, the three curves (each representing one of the three consecutive runs) lay on top of each other, indicating that temperature variation is not a significant factor affecting pinion speed over the range of temperatures tested.

Accordingly, regardless of embodiment of starter system 20, the rotational speed of motor 40, and thus of pinion 44, at a predetermined time, may be predicted on the basis of elapsed time after energization of motor 40; in some embodiments, the speed prediction may even account for variances in the applied motor voltage. In each embodiment or operational mode of system 20, the time of starter motor activation and the applied starter motor voltage (which may be assumed to be battery voltage, and which may, in some embodiments, further be assumed to be, for example, a constant 12V,) are parameters that typically are already known or sensed and provided to the vehicle/engine electronics system, and thus to ECU 28. As such, implementation of starter system 20 requires no dedicated, additional sensor(s) for obtaining the predicted speed of pinion 44 at a predetermined time after starter motor energization, facilitating its smooth engagement with engine ring gear 32, regardless of whether engine 22 is to be cranked while already rotating (i.e., a warm start) or from rest (i.e., a cold start). From the preceding description, it can also be understood that each embodiment of starter system 20 facilitates determination of the starter pinion speed in an open loop manner, without the need for a control scheme reliant upon closed loop feedback by which the starter motor or pinion position or speed is sensed. Therefore, starter system 20 requires no dedicated, additional sensor(s) for obtaining the predicted speed at a predetermined time after starter motor energization, thereby simplifying starter system packaging and minimizing part complexity. Thus, incorporation of starter system 20 simplifies starter system packaging and minimizes system part complexity vis-à-vis prior starter systems having engine stop-start operation capabilities.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto.

What is claimed is:

1. A method for controlling an engine starter system, said method comprising:

providing an electronic control unit having an engine speed input and at least one output;

providing a starter capable of being controlled by the electronic control unit and having an electric motor and a pinion, the motor and pinion coupled together for transferring rotational torque from the motor to the pinion when the motor is activated;

controlling activation of the motor with an electronic control unit output motor signal in response to an engine speed input signal;

determining with the electronic control unit the pinion speed in an open loop manner based solely on the time since activation of the motor and the voltage applied to the motor; and selectively moving the pinion between a retracted state and an extended state in response to an electronic control unit output pinion signal, whereby the starter is capable of selectively engaging an engine for cranking the engine.

2. The method of claim 1, wherein the electronic control unit output motor signal and the electronic control unit output pinion signal are signals separately outputted from the electronic control unit.

3. The method of claim 2, wherein the electronic control unit output motor signal and the electronic control unit output pinion signal are substantially simultaneously outputted from the electronic control unit.

4. The method of claim 1, wherein the electronic control unit output motor signal and the electronic control unit output pinion signal are a single signal outputted from the electronic control unit.

5. The method of claim 1, wherein the pinion speed determined by the electronic control unit is expressible as an explicit, closed form equation based on elapsed time since activation of the motor and the voltage applied to the motor.

6. The method of claim 5, wherein the explicit, closed form equation is a quartic equation.

7. The method of claim 1, wherein in determining the pinion speed with the electronic control unit the voltage applied to the motor is substantially battery voltage.

8. The method of claim 1, wherein in determining the pinion speed with the electronic control unit the voltage applied to the motor is presumed to be a constant value.

9. The method of claim 1, wherein the pinion speed is a presumed predetermined speed after an identified period of time has elapsed since motor activation.

10. The method of claim 1, wherein the pinion speed is determined based at least in part as a function of actual applied motor voltage.

11. The method of claim 1, further comprising calculating the differential between the determined pinion speed and the engine speed input.

12. The method of claim 11, wherein the voltage applied to the motor is maintained if the determined pinion speed is less than the engine speed input.

13. The method of claim 11, wherein the pinion is capable of being engaged with an engine ring gear if the determined pinion speed is at least the engine speed input.

14. A starter system for cranking an engine, comprising:

a starter comprising an electric motor and a pinion coupled together, rotational torque from the motor transferable to the pinion; and an electronic control unit having an engine speed input and at least one output, the motor adapted for being activated under control of the electronic control unit in response to a motor signal outputted from the electronic control unit, the pinion adapted for being moved axially between a retracted state and an extended state in response to a pinion signal outputted from the electronic control unit, the starter capable of engaging and cranking an engine in the pinion extended state, the electronic control unit capable of determining the pinion speed in an open loop manner based solely on the time since activation of the motor and the voltage applied to the motor.

15. The starter system of claim 14, wherein the electronic control unit is adapted to determine pinion speed based at least in part as a function of the voltage applied to the motor being substantially battery voltage.

16. The starter system of claim 14, wherein the electronic control unit is adapted to determine pinion speed based at least in part as a function of the voltage applied to the motor being presumed to be a constant value.

17. The starter system of claim 14, wherein the electronic control unit is adapted to adjust the pinion speed on the basis of a comparison by the electronic control unit between the determined pinion speed and the engine speed input.

18. The starter system of claim 14, wherein the electronic control unit has a motor output from which the motor signal is outputted from the electronic control unit and a separate pinion output from which the pinion signal is outputted from the electronic control unit.

19. The starter system of claim 18, wherein the electronic control unit is capable of outputting the motor signal from the motor output and the pinion signal from the pinion output substantially simultaneously.

20. The starter system of claim 14, wherein the electronic control unit output is a single output from which a single motor and pinion signal is outputted.

* * * * *